US006733229B2

(12) United States Patent
Burdgick et al.

(10) Patent No.: US 6,733,229 B2
(45) Date of Patent: May 11, 2004

(54) INSERT METERING PLATES FOR GAS TURBINE NOZZLES

(75) Inventors: Steven S. Burdgick, Schenectady, NY (US); Gary Itzel, Greenville, SC (US); Sanjay Chopra, Schenectady, NY (US); Nesim Abuaf, Schenectady, NY (US); Victor H. Correia, Milton Mills, NH (US)

(73) Assignee: General Electric Company, Schenectady, NY (US)

( * ) Notice: Subject to any disclaimer, the term of this patent is extended or adjusted under 35 U.S.C. 154(b) by 138 days.

(21) Appl. No.: 10/092,572

(22) Filed: Mar. 8, 2002

(65) Prior Publication Data

US 2003/0170113 A1 Sep. 11, 2003

(51) Int. Cl.[7] ..... F01D 9/06

(52) U.S. Cl. ..... 415/1; 415/116; 416/96 A; 416/97 R

(58) Field of Search ..... 415/1, 116, 115, 415/114; 416/96 A, 96 R, 97 R

(56) References Cited

U.S. PATENT DOCUMENTS

| | | | | |
|---|---|---|---|---|
| 6,019,572 A | * | 2/2000 | Cunha | 415/114 |
| 6,416,275 B1 | * | 7/2002 | Itzel et al. | 415/116 |
| 6,561,757 B2 | * | 5/2003 | Burdgick et al. | 415/115 |

* cited by examiner

*Primary Examiner*—Edward K. Look
*Assistant Examiner*—Kimya N McCoy
(74) *Attorney, Agent, or Firm*—Nixon & Vanderhye PC

(57) ABSTRACT

The invention comprises a metering plate which is assembled to an impingement insert for use in the nozzle of a gas turbine. The metering plate can have one or more metering holes and is used to balance the cooling flow within the nozzle. A metering plate with multiple holes reduces static pressure variations which result from the cooling airflow through the metering plate. The metering plate can be assembled to the insert before or after the insert is inserted into the nozzle.

6 Claims, 2 Drawing Sheets

INSERT METERING PLATES FOR GAS TURBINE NOZZLES

This invention was made with Government support under Contract No. DE-FC21-95ZMC31176 awarded by the Department of Energy. The Government has certain rights in this invention.

BACKGROUND AND SUMMARY OF THE INVENTION

The invention relates to the provision of metering plates together with impingement inserts for use in gas turbine nozzles.

Gas turbine nozzles typically use impingement inserts inside of the nozzle to cool the airfoil walls. If the nozzle has a multiple circuit cooling system then there may be unbalanced cooling flow to the different circuits of the nozzle.

To overcome the problem described in the prior art, metering plates are used with or without impingement inserts to balance cooling flow to the different circuits of the nozzle. In one embodiment of the invention, a metering plate with a single metering hole is used.

In a second and preferred embodiment of the invention, a metering plate is used with multiple holes to overcome potential flow disruption which can be caused by a single metering hole. More specifically, when using only one metering hole in a metering plate a flow disruption occurs that produces a variable static pressure distribution in the area just below the metering plate. This variability in static pressure distribution relative to the rest of the impingement insert can cause variable impingement pressure ratios across impingement holes leading to back-flow issues and/or reduce cooling effectiveness. This flow field disruption is produced by the Vena Contracta of the orifice. Using several metering holes instead of just one significantly reduces the static pressure variation downstream of the metering plate.

DETAILED DESCRIPTION OF THE INVENTION

The invention involves a metering plate having one or more holes, combined with or without an associated impingement insert, installed in a gas turbine nozzle for equalizing the balance of cooling flow to different circuits of a nozzle. Multiple holes in the metering plate are preferably used for reducing static pressure variation in the area near the exit of the metering plate.

Figure 1:
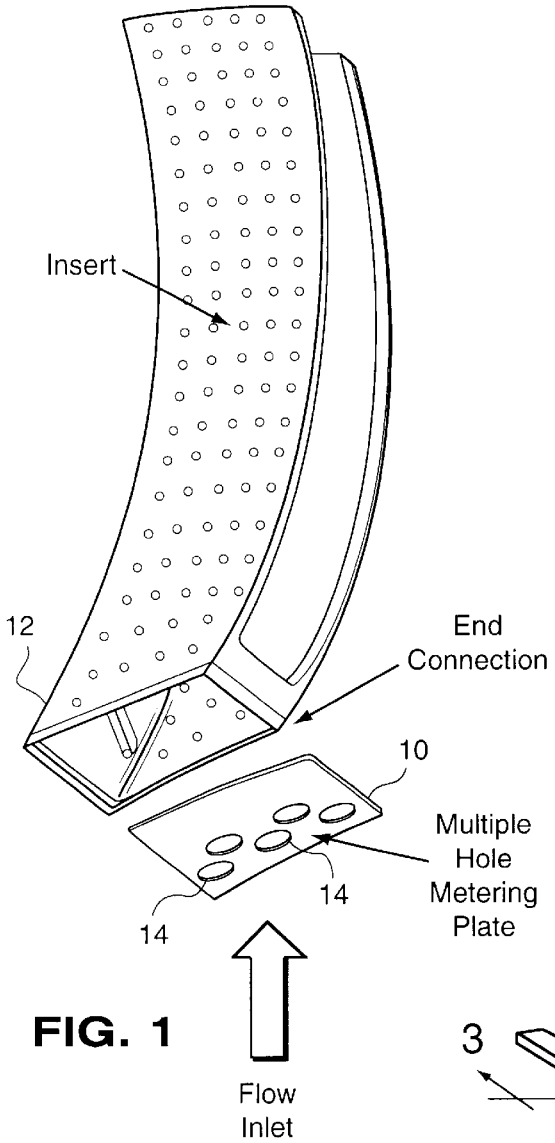
FIG. 1 shows a typical impingement insert combined with a multiple hole metering plate at the flow inlet.

As shown in FIG. 1, metering plate 10 is attached to the inlet portion of a nozzle impingement insert 12. Metering plate 10 can be attached either on top of the insert after assembly in the nozzle or as part of the insert at the extreme entrance interface prior to installation. Metering plate 10 can be attached to insert 12 by, for example, welding.

In the preferred embodiment, metering plate 10 has multiple holes 14 so as to reduce the static pressure variation caused by the Vena Contracta effect produced by flow through a single metering hole. Thus, a multiple hole metering plate achieves the desired impingement flow through impingement holes near the exit of the metering plate. The actual pattern of the metering holes is specific to the characteristics and physical parameters of the nozzle.

Figure 2:
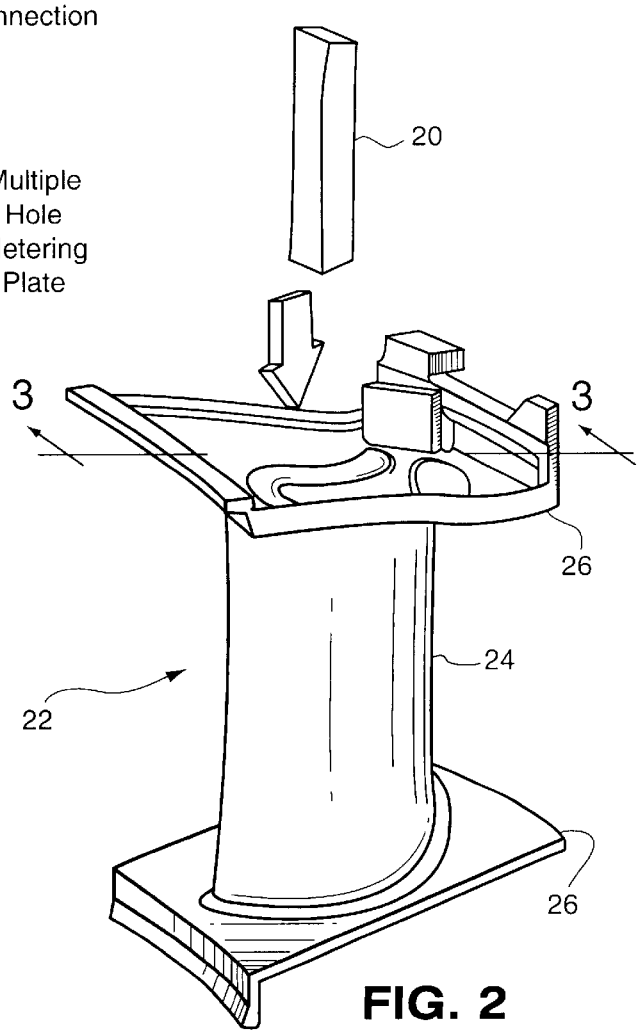
FIG. 2 shows the assembled insert and metering plate being inserted into a nozzle assembly.

FIG. 2 shows an assembled insert and metering plate 20 being inserted into nozzle assembly 22. Nozzle assembly 22 includes airfoil 24 and impingement plate assemblies 26 located at either end of airfoil 24. Alternatively, an insert 12 can be assembled into nozzle 22 and, subsequently, metering plate 14 can be attached to the top of insert 12.

Figure 3:
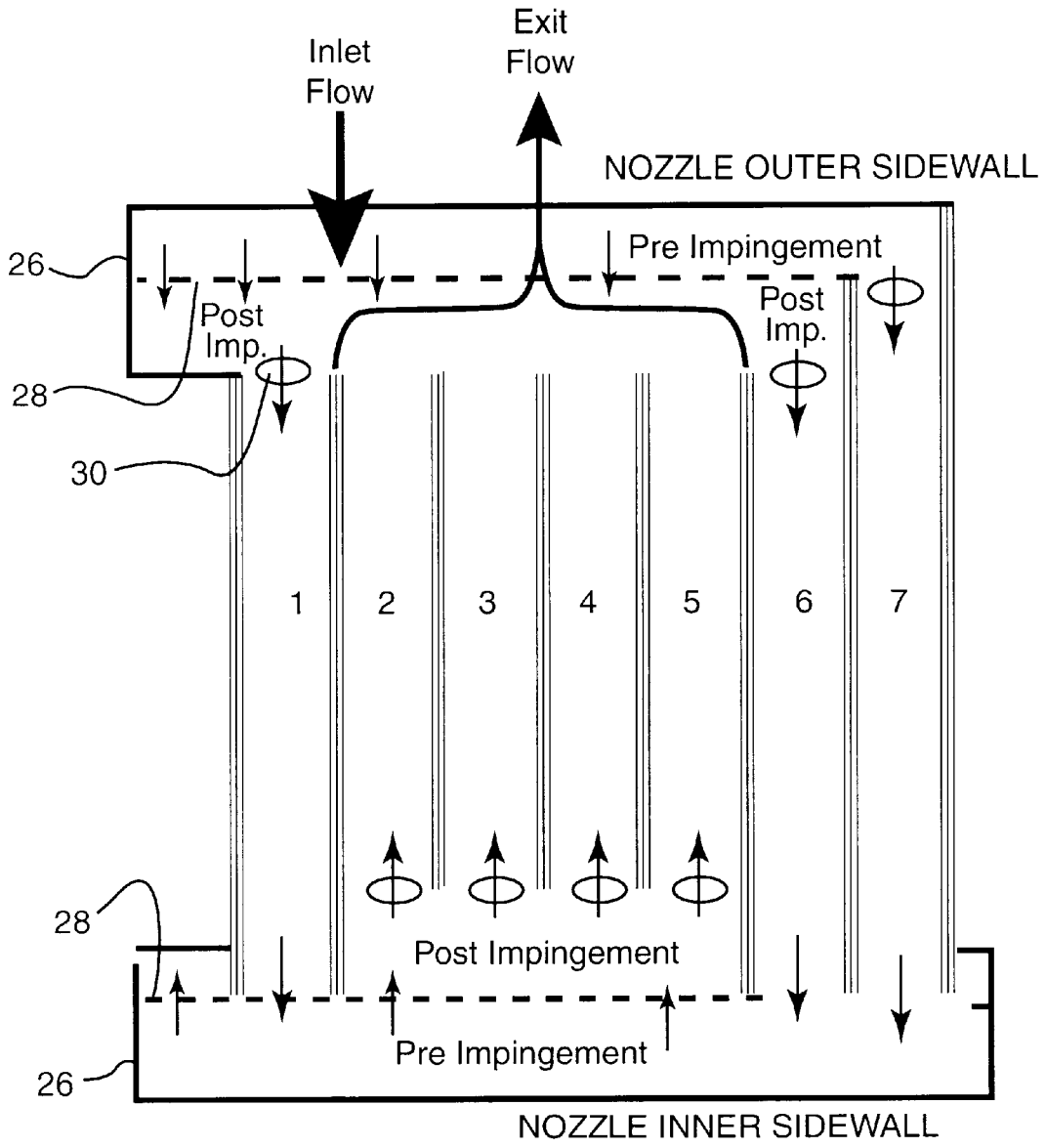
FIG. 3 schematically shows in cross section the nozzle assembly of FIG. 2 and depicts a multiple circuit cooling system within the nozzle assembly.

FIG. 3 shows the flow paths through a nozzle assembly having a multiple circuit cooling system. In FIG. 3, airflow through the nozzle assembly 22 is shown by the arrows. In particular, at the top of nozzle assembly 22, inlet air flows into the nozzle assembly as shown by the arrow traversing the nozzle outer sidewall. The airflow continues within the nozzle assembly through pre-impingement plate assembly 26, through pre-impingement plate 28 with respect to cavities 1 and 6, and downward through cavities 1, 6 and 7. As it exits these cavities, the airflow in cavity 1 passes through another pre-impingement plate 28 at the exit end of the cavity while the airflow in cavities 6 and 7 does not exit through pre-impingement plate 28.

Arrows 30, shown in FIG. 3 with an oval around their base, depict airflow that has passed through a metering plate. Thus, as shown in FIG. 3, airflow in cavities 1, 6 and 7 has passed through respective metering plates. Cavity 7, however, is shown not to include pre-impingement plate 28 and, accordingly, the inlet air passes directly through a metering plate into the cavity. Similarly, cavities 1, 6 and 7 may or may not include pre-impingement plates, metering plates and/or inserts depending on the cooling needs of those portions of the nozzle assembly.

The use of metering plates in cavities 1, 6 and 7 serves to spread or apportion the inlet airflow between these cavities. After traversing cavities 1, 6 and 7 the airflow enters cavities 2–5 after passing through metering plates at their inlets, as depicted by arrows 30 in FIG. 3. The metering plates in cavities 2–5 are also provided to spread or apportion the airflow between these cavities. Depending upon the physical characteristics of the nozzle assembly, particular cavities may or may not require pre-impingement plates, metering plates and/or impingement inserts. For example, cavity 5 may or may not need to be provided with a pre-impingement plate, metering plate and/or impingement insert. More particularly, suitable metering plates provided to cavities 2–4 may obviate the need for a metering plate in cavity 5 (not shown).

As further shown in FIG. 3, the cooling air exits the nozzle assembly through pre-impingement plate 28 and the nozzle outer sidewall after traversing cavities 2–5. As described above, the airflow in cavity 7 does not pass through pre-impingement plate 28, but does pass through a metering plate, and cavity 5 may or may not require a pre-impingement plate, an impingement insert and/or metering plate. In practice, achieving the desired airflow within the nozzle assembly and/or the impingement flow through impingement holes near the exit of the metering plate can be arrived at by either iteration on analytical models or via testing actual hardware. The metering hole plate serves two basic purposes, namely, metering the airflow down the cavity and impinging airflow on the sidewall to the airfoil.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A nozzle assembly for directing cooling airflow in a gas turbine nozzle, said nozzle assembly comprising:

an impingement insert for cooling the nozzle airfoil walls; and a metering plate, having at least one metering hole, for balancing cooling airflow within different circuits of the nozzle;

said insert and metering plate being attached together prior to insertion into the nozzle.

2. A nozzle assembly as in claim 1, said metering plate having more than one metering hole.

3. A nozzle assembly as in claim 1, said metering plate being designed so as to reduce static pressure variation produced by cooling airflow passing through the metering plate.

4. A nozzle assembly as in claim 1, said insert and metering plate being attached by welding.

5. A method for directing cooling airflow within a multi cavity gas turbine nozzle, said method comprising:

forming at least one assembly of an impingement insert and a metering plate; and inserting said at least one assembly into one of the cavities of the gas turbine nozzle.

6. A method as in claim 5, including welding together said impingement insert and said metering plate.

* * * * *